United States Patent [19]

Mesa

[11] Patent Number: 4,787,224

[45] Date of Patent: Nov. 29, 1988

[54] MECHANISM FOR KEYLESS LOCK SYSTEMS

[76] Inventor: Rafael F. Mesa, Torrente Flores 92 - 2a, Barcelona, Spain

[21] Appl. No.: 43,158

[22] Filed: Apr. 27, 1987

[30] Foreign Application Priority Data

Apr. 29, 1986 [ES] Spain ..... 555377

[51] Int. Cl.[4] ..... E05B 37/00

[52] U.S. Cl. ..... 70/313; 70/288; 70/299

[58] Field of Search ..... 70/287, 288, 297, 298, 70/299, 306, 313

[56] References Cited

U.S. PATENT DOCUMENTS 1,480,759 1/1924 Hill ..... 70/313

1,618,841 2/1927 McMenamin ..... 70/287

3,435,647 4/1969 LeBlanc ..... 70/298

*Primary Examiner*—Robert L. Wolfe

*Attorney, Agent, or Firm*—Ladas & Parry

[57] ABSTRACT

A mechanism for a keyless lock has a generally prismatic body with a longitudinal hole and orthogonal transverse holes therethrough. A longitudinal cylinder axially movably in the longitudinal hole carries a lock-operating element and has concavely-rounded annular cuts respectively receiving retaining cylinders axially movably in the transverse holes for preventing lock-operating axial movement of the longitudinal cylinder until concavely-rounded annular cuts on the retaining cylinders are aligned with the longitudinal cylinder by axial movement of the retaining cylinders. Independent advancing mechanism on the body for the respective retaining cylinders have pulsators which are pushed to so move the retaining cylinders incrementally.

12 Claims, 1 Drawing Sheet

MECHANISM FOR KEYLESS LOCK SYSTEMS

The invention relates to a mechanism for a keyless, i.e. combination lock.

The mechanism proposed by the invention is very simple in concept and reliable in operation. It has a prismatic body with a longitudinal hole for a longitudinal cylinder which carries a locking element. The longitudinal cylinder is axially movable for opening the lock or restrained from axially moving for locking the lock.

The axial movability of the longitudinal cylinder depends on the position of a plurality of retaining cylinders axially movable in transverse holes in the body, orthogonal to the former, longitudinal hole, with the geometric axes of the transverse and longitudinal holes at a distance from each other which is less than the sum of the radii thereof. The longitudinal cylinder has concavely-rounded annular cuts for respectively receiving the retaining cylinders relative thereto. The retaining cylinders thus restrain lock-operating axial movement of the longitudinal cylinder, but they also have concavely-rounded annular cuts, at different positions along the retaining cylinders, for such axial movement when these are aligned with the longitudinal cylinder. In order to so align their annular cuts with the longitudinal cylinder, an independent advance mechanism is provided for each retaining cylinder.

For this, an end zone of each retaining cylinder is provided with a plurality of annular cuts which define a saw-toothed annular structure. Lugs are retractable orthogonally with respect to the respective retaining cylinders in diametrical holes of respective lug holders which, in turn, can axially move in blind holes situated near and parallel to the transverse holes for guiding the retaining cylinders in the prismatic body. The lug holders are each floatingly positioned between ends of two helicoidal, axial springs, the other end of the inside one of which contacts the bottom of the blind hole the lug holder is guided in. The other spring is supported at its other, free end on a pulsator, which emerges from the body.

Pressing the respective pulsators advances only the corresponding retaining cylinder a distance equivalent to the teeth spacing of the saw-toothed structure. The new position reached by the retaining cylinder is maintained by a spring-recovering pawl device situated at a diametrically opposed position with a respect to the lug. Thus, by pressing a certain number of times on a pulsator, the corresponding retaining cylinder is incrementally advanced until the annular cut thereof is made to coincide with the longitudinal cylinder carrying the locking element of the lock.

When all the pulsators have been pressed the necessary number of times for moving the annular cuts of the retaining cylinders to the longitudinal cylinder, the latter can be freely moved axially in the desired lock-locking or lock-opening sense. The number of times it is necessary to press each pulsator is the opening combination of the thereby-keyless lock.

Safety locking is achieved by displacing axially, in one axial sense or in the other, all the pawl devices simultaneously so that their lugs are removed from the saw-toothed structures. All the retaining cylinders then move backward via a spring, until they are stopped by a stop, e.g. a plate. For this, in a preferred embodiment, all the pawl devices are located in diametrical holes of a cylindrically-shaped blocking-unblocking element, which is capable of displacement in a circular cross-section, longitudinal hole of the prismatic body.

DESCRIPTION OF THE DRAWING

In order to make comprehension of the invention easier, there is an attached drawing, in which, for illustration and not limitation.

DETAILED DESCRIPTION

Figure 1:
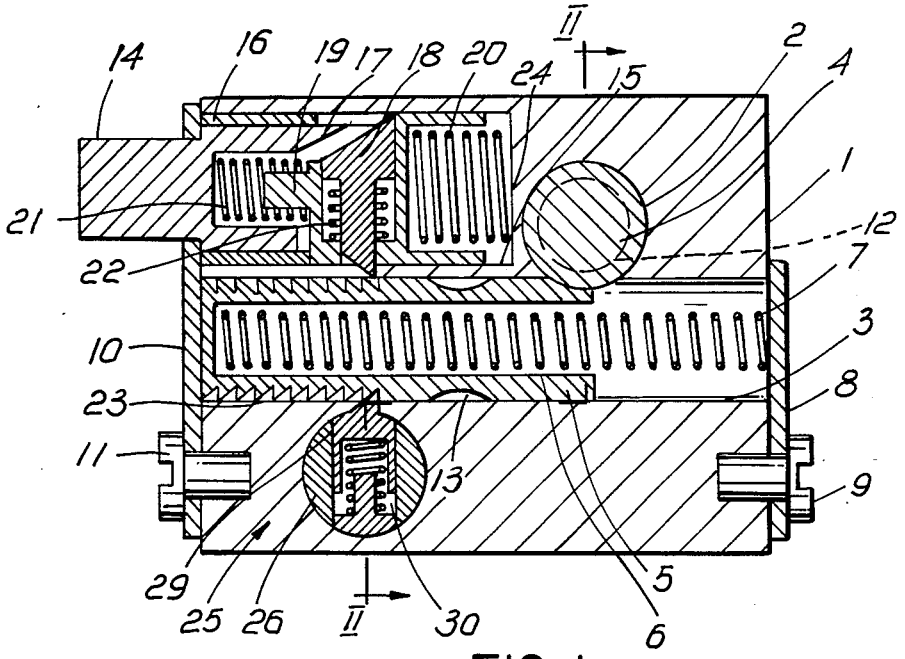
FIG. 1 is an elevation, mostly in section, of an embodiment of the invention.

As shown in the Figures, a massive body 1, having a generally prismatic shape, is provided with a longitudinal hole 2 and a series of holes 3 transverse thereto. The geometrical axes of the holes 2, 3 therefore cross orthogonally, and they are at a distance from each other less than the sum of their respective radii. In the longitudinal hole 2 is a cylinder 4 that carries a locking element (not shown) for axial displacement.

In the transverse holes 3 are respective retaining cylinders 5 (only one shown), which retain the longitudinal cylinder 4, preventing it from moving axially. The retaining cylinders 5 are shorter than the holes 3 they are in and have respective axial blind bores 6 (only one shown) that receive one end of respective helical springs 7 (only one shown), the opposite ends of the springs 7 being supported on a longitudinal plate 8 that is held against one face of the body 1 by screws 9 (only one shown). The pressure of each spring 7 keeps one, blind-bore-bottom end of its respective retaining cylinder 5 against another plate 10 that is fixed to the opposite face of the body 1 by screws 11 (only one shown).

For relatively positioning the retaining cylinders 5 and the longitudinal cylinder 4, the longitudinal cylinder 4 has annular cuts 12 at appropriate positions, the cuts having a concavely-rounded curvature complementary to that of the retaining cylinders 5 they receive.

Each of the retaining cylinders 5 has, at respectively different positions, an annular cut 13 (only one shown), also with a concavely-rounded curvature, in this case complementary to that of the longitudinal cylinder 4. With the retaining cylinders 5 in the positions shown for one in FIG. 1, the cuts 13 are spaced from the longitudinal cylinder 4. This restrains the longitudinal cylinder 4 from moving axially, because its annular cuts 12 receive each of the retaining cylinders 5. If all the annular cuts 13 of the retaining cylinders 5 were situated at the longitudinal cylinder 4, however, the latter could move freely, and the lock would than be in its openable position.

For this, an independent advance mechanism (only one shown) for each retaining cylinder 5 moves it so that its annular cut 13 is situated at the longitudinal cylinder 4.

Each independent advance mechanism has a pulsator 14 (only one shown) located in a respective one of transverse blind holes 15 (only one shown) in the body 1 correspondingly to a corresponding one of the retaining cylinders 5. The pulsators 14 are movably guided in sleeves 16 (only one shown) in the blind holes 15 and have wedge-shaped ends 17 (only one shown) therein for moving respective lugs 18 (only one shown) orthogonally, diametrically of respective lug holders 19 (only one shown), which are movably guided inside the blind holes 15. The lug holders 19 are in floating positions between respective end springs 20 and 21 (only one each shown), the end springs 20 being between the respective lug holders 19 and blind ends 24 (only one shown) of the blind holes 15, and the end springs 21 being between the respective lug holders 19 and pulsators 14. The lugs 18 are normally kept in withdrawn positions, within the blind holes 15, by the action of further springs 22 (only one shown) in the lug holders 19.

Each of the retaining cylinders 5 is provided at its one, blind-bore-bottom end zone, i.e. the zone at the one end which contacts the plate 10 on the body 1, with a series of annular slots, which are close enough to each other to define an annular saw-toothed structure 23 (only one shown). End portions of the lugs 18 can fit between two of the teeth of the respective toothed structures when the end portions of the lugs 18 are caused to emerge from the lug holders 19 by the orthogonal movement of the lugs caused by the respective pulsators 14.

Thus, when the pulsator 14 shown in FIG. 1 is initially pushed into the block 1, the lug 18 is first displaced towards the toothed structure 23 as the wedge-shaped end 17 of the former contacts a cut of identical angle on the adjacent end portion of the lug 18, thereby making the latter move against its spring 22, because the lug holder 19 does not move appreciably, because it is held by the spring 20 from the blind bottom of the hole 15. Once the lug 18 is introduced between two teeth of the toothed structure 23, however, further pressing of the pulsator 14 causes simultaneous axial displacement of the pulsator and, via the lug 18, the retaining cylinder 5. This displacement continues until the inner end of the lug holder 19, at the spring 20, contacts the bottom 24 of the blind hole 15. The distance of such displacement corresponds to the distance between successive teeth in the toothed structure 23, so that each push of the pulsator advances the retaining cylinder 5 a distance corresponding to a single tooth, i.e. the distance between successive teeth.

Such one-tooth advance of the retaining cylinders 5 is held by respective pawl devices at 25. Each of these allows the corresponding retaining cylinder 5 to advance, but not to withdraw as urged by its spring 7. Accordingly, by repeatedly pushing a pulsator 14, the corresponding retaining cylinder 5 advances an equal number of teeth of the toothed zone 23, and, if one presses a correct number of times, it is possible to make the annular slot 13 of the retainer coincide with the longitudinal cylinder 4. By carrying out this operation for each of the pulsators 14, the longitudinal cylinder 4, which is related to the locking element (not shown), is released for linear movement opening or locking the lock.

By varying the relative positions of the annular cuts 13 of the retaining cylinders 5, a wide range of such lock-opening combinations can be established. This range can be further increased by increasing the number of pulsators 14 and related elements.

In the embodiment shown in the Figures, the pawl device at 25 is a cylindrical pin 26 guided in a longitudinal hole 27 of the prismatic body 1. The pin 26 has a plurality of diametrical holes 28 at distances corresponding to the separation between retaining cylinders 5. In these holes 28 are retractable lugs 29, which are urged by springs 30 (only one shown) towards the toothed zones 23 of the retaining cylinders 5 for engaging between the teeth thereof, as can be seen in detail in FIG. 2. The lugs 29 are pall shaped to withdraw during the advance of the retaining cylinders 5 and then restrain them from withdrawing in order to fulfill their pawl function.

Figure 2:
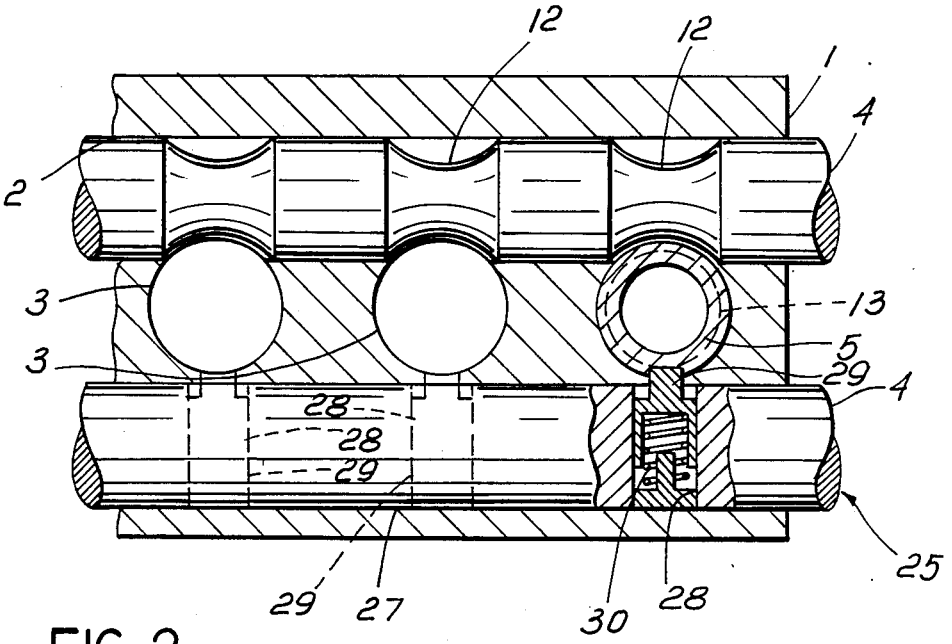
FIG. 2 a longitudinal elevation, transverse to that of FIG. 1 and partly in section on line II—II in FIG. 1, of the embodiment of FIG. 1.

Because all the lugs 29 for all the retaining cylinders 5 are in the common pall-device pin 26, axial displacement of the pin 26 in either direction produced by acting on either end of the pin 26 ends displaces all the lugs from the annular toothed structures 23, and the springs 7 move all the retaining cylinders 5 to the plate 10. The longitudinal cylinder 4 that carries the locking element is then completely blocked by all the retaining cylinders 5. This is, therefore, a safety position of the lock. The pin 26 of the pawl device 25 acts, therefore, as a lock-blocking element, until the pin is manually returned to its original lock-unblocking position as shown in FIGS. 1 and 2.

I claim:

1. A mechanism for a keyless lock, comprising:

a generally prismatic body having a longitudinal hole and, orthogonal thereto, a plurality of transverse holes through the body, the longitudinal and transverse holes having geometric axes at respective distances from each other less than the respective sums of the radii thereof;

a longitudinal cylinder for carrying a locking element axially movable in the longitudinal hole for lock-operating movement of the locking element, the longitudinal cylinder having concavely-rounded annular cuts thereabout;

retaining cylinders respectively having concavely-rounded annular cuts at positions therealong and being movable axially in the transverse holes for respective receipt in the annular cuts of the longitudinal cylinder, whereby to restrain the lock-operating axial movement of the longitudinal cylinder and, upon axial movement of the retaining cylinders in one direction, for aligning the concavely-rounded annular cuts of all the retaining cylinders with the longitudinal cylinder, whereby to allow the lock-operating axial movement of the latter, each retaining cylinder having a plurality of other, teeth annular cuts which define a saw-toothed structure about one end thereof in the block; and independent advance means respectively for axially moving the retaining cylinders, each independent advance means comprising a pulsator movably emerging from the body and lug means in the body responsive to pushing the pulsator into the body for engaging the saw-toothed structure of a corresponding retaining cylinder and incrementally moving the latter in the one direction in the transverse hole it is in.

2. The mechanism for a keyless lock of claim 1, wherein each lug means comprises a blind hole having a blind bottom in the body, near and in parallel to the transverse hole of the corresponding retaining cylinder, a lug holder floatingly supported by springs between the pulsator, the lug holder and the blind bottom of the blind hole for axial movement in the blind hole by the pulsator the distance between two adjacent teeth of the saw-toothed structure of the corresponding retaining cylinder, and a lug in the lug holder for movement therewith and for movement by the pulsator into engagement with the saw-toothed structure of the corresponding retaining cylinder, whereby to move the latter axially.

3. The mechanism for a keyless lock of claim 2, wherein each lug holder comprises a diametrical hole for the lug therein, whereby the lug can emerge for the engagement with the saw-toothed structure, and spring means for normally withdrawing the lug into the lug holder and out of engagement with the saw-toothed structure when not so moved by the pulsator.

4. The mechanism for a keyless lock of claim 3, wherein each pulsator has a wedge-shaped end in the block for contacting an identical-angle cut on the corresponding lug when the pulsator is pushed and thereby first moving the lug into the engagement with the saw-toothed structure of the corresponding retaining cylinder and thereafter moving the latter.

5. The mechanism for a keyless lock of claim 1, and further comprising:

another longitudinal hole in the body;

a block-unblocking element displaceable in the other longitudinal hole;

retaining-cylinder spring means for axially moving the respective retaining cylinders in the opposite direction when not engaged by the lug means, whereby the annular cuts of the retaining cylinders move away from the longitudinal cylinder; and pall devices on the blocking-unblocking element at the respective retaining cylinders when the blocking-unblocking element is moved to one position for holding the respective retaining cylinders against movement by the retaining-cylinder spring means.

6. The mechanism for a keyless lock of claim 2, and further comprising:

another longitudinal hole in the body;

a block-unblocking element displaceable in the other longitudinal hole;

retaining-cylinder spring means for axially moving the respective retaining cylinders in the opposite direction when not engaged by the lug means, whereby the annular cuts of the retaining cylinders move away from the longitudinal cylinder; and pall devices on the blocking-unblocking element at the respective retaining cylinders when the blocking-unblocking element is moved to one position for holding the respective retaining cylinders against movement by the retaining-cylinder spring means.

7. The mechanism for a keyless lock of claim 3, and further comprising:

another longitudinal hole in the body;

a block-unblocking element displaceable in the other longitudinal hole;

retaining-cylinder spring means for axially moving the respective retaining cylinders in the opposite direction when not engaged by the lug means, whereby the annular cuts of the retaining cylinders move away from the longitudinal cylinder; and pall devices on the blocking-unblocking element at the respective retaining cylinders when the blocking-unblocking element is moved to one position for holding the respective retaining cylinders against movement by the retaining-cylinder spring means.

8. The mechanism for a keyless lock of claim 4, and further comprising:

another longitudinal hole in the body;

a block-unblocking element displaceable in the other longitudinal hole;

retaining-cylinder spring means for axially moving the respective retaining cylinders in the opposite direction when not engaged by the lug means, whereby the annular cuts of the retaining cylinders move away from the longitudinal cylinder; and pall devices on the blocking-unblocking element at the respective retaining cylinders when the blocking-unblocking element is moved to one position for holding the respective retaining cylinders against movement by the retaining-cylinder spring means.

9. The mechanism for a keyless lock of claim 5, wherein the blocking-unblocking element is a cylinder with diametric holes and the pall devices comprise spring-recovering lugs in the diametric holes of the cylinder.

10. The mechanism for a keyless lock of claim 6, wherein the blocking-unblocking element is a cylinder with diametric holes and the pall devices comprise spring-recovering lugs in the diametric holes of the cylinder.

11. The mechanism for a keyless lock of claim 7, wherein the blocking-unblocking element is a cylinder with diametric holes and the pall devices comprise spring-recovering lugs in the diametric holes of the cylinder.

12. The mechanism for a keyless lock of claim 8, wherein the blocking-unblocking element is a cylinder with diametric holes and the pall devices comprise spring-recovering lugs in the diametric holes of the cylinder.

* * * * *

UNITED STATES PATENT AND TRADEMARK OFFICE

CERTIFICATE OF CORRECTION

PATENT NO. : 4,787,224

DATED : November 29, 1988

INVENTOR(S) : RAFAEL FLORIT MESA

It is certified that error appears in the above-identified patent and that said Letters Patent is hereby corrected as shown below:

Title page, Item [76], "F." should be -- Florit --.

Item (19) "Mesa" should read -- Florit Mesa --.

Signed and Sealed this

Fifteenth Day of August, 1989

*Attest:*

DONALD J. QUIGG

*Attesting Officer*

*Commissioner of Patents and Trademarks*